US007819051B1

(12) United States Patent
Beckmann et al.

(10) Patent No.: US 7,819,051 B1
(45) Date of Patent: Oct. 26, 2010

(54) ELECTRONICALLY IGNITED FIREARMS

(75) Inventors: Rudi Beckmann, Aichhalden (DE); Michael Schumacher, Fluorn-Winzeln (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 586 days.

(21) Appl. No.: 11/753,371

(22) Filed: May 24, 2007

Related U.S. Application Data

(63) Continuation of application No. PCT/EP2005/012548, filed on Nov. 23, 2005.

(30) Foreign Application Priority Data

Nov. 24, 2004 (DE) ..... 10 2004 056 712

(51) Int. Cl.
*F41A 19/70* (2006.01)

(52) U.S. Cl. ..... 89/135; 42/84

(58) Field of Classification Search ..... 42/84; 89/135

See application file for complete search history.

(56) References Cited

U.S. PATENT DOCUMENTS

| | | | | |
|---|---|---|---|---|
| 514,491 | A * | 2/1894 | McCullough | 42/84 |
| 1,782,148 | A * | 11/1930 | Ross | 89/133 |
| 2,800,057 | A | 7/1957 | Hoopes | |
| 2,868,081 | A | 1/1959 | Grover | |
| 6,286,246 | B1 | 9/2001 | Rachal et al. | |
| 6,345,462 | B1 | 2/2002 | Mikuta et al. | |

FOREIGN PATENT DOCUMENTS

| | | | |
|---|---|---|---|
| CH | 679243 | A5 * | 1/1992 |
| DE | 2949130 | | 6/1981 |
| WO | 9855817 | | 12/1998 |
| WO | 9937967 | | 7/1999 |
| WO | 2004010070 | | 1/2004 |

OTHER PUBLICATIONS

English translation of the Written Opinion of the International Preliminary Examination Report for international patent application serial No. PCT/EP2005/012548.

English translation of the International Search Report for international patent application serial No. PCT/EP2005/012548.

* cited by examiner

*Primary Examiner*—Stephen M Johnson
(74) *Attorney, Agent, or Firm*—Hanley, Flight & Zimmerman, LLC

(57) ABSTRACT

A firearm for firing electrically ignitable cartridges is described. An example firearm includes an electric circuit, a breech block, and a firing pin held in the breech block. The firing pin includes an ignition tip. Furthermore, the example firearm includes a contact lever, wherein movement of the contact lever is coupled to movement of the breech block. In addition, the contact lever is couplable to at least one of the electric circuit or the firing pin, and the contact lever interrupts electrical contact between the electric circuit and the firing pin when the breech block is open.

28 Claims, 5 Drawing Sheets

ELECTRONICALLY IGNITED FIREARMS

RELATED APPLICATIONS

This patent is a continuation of International Patent Application Serial No. PCT/EP2005/012548, filed Nov. 11, 2005, which claims priority to German Patent Application 10 2004 056 712.3, filed on Nov. 24, 2004, both of which are hereby incorporated herein by reference in their entireties.

FIELD OF DISCLOSURE

This disclosure relates generally to firearms, and, more particularly, electronically ignited firearms.

BACKGROUND

There have been attempts to use electrically ignited ammunition in multiple-shot handguns. Conventional multiple-shot handguns that can fire electrically ignitable cartridges include an electric circuit for the generation of the ignition voltage. Such weapons also include a breech and a firing pin held in the breech, whose ignition tip rests on the cartridge bottom of a loaded cartridge when the breech is closed. Some examples of these conventional firearms are described in German Patent 29 49 130, U.S. Pat. No. 6,286,242, and WIPO publications WO 98/55817 and WO 2004/010070.

One advantage of electronically ignited ammunition is that the ammunition will not be ignited by an inadvertent impact, as may occur, for example, in the case of an accidentally fired conventional cartridge. A further advantage of electronically ignited ammunition is the fact that such ammunition is not widespread and cannot be produced with conventional loading components—at least not without great trouble or difficulty. Thus, unauthorized persons cannot procure such ammunition, even in low quantity, without expending considerable time and effort.

However, the previous efforts to construct a handgun that can electronically ignite ammunition that is simple and reliable have many disadvantages. For example, some of the conventional weapons described above have long signal lines that fail frequently and easily, and some have sliding contacts that can become soiled. In addition, many of these handguns with electronic ignition do not have useful lives as long as conventional handguns, do not have a comparable supply of ammunition available as do conventional handguns, and are not safer in function and cheaper in production than comparable conventional weapons.

Furthermore, handguns, such as those described above and other self-loading pistols, are locked during firing in order to shoot a powerful cartridge. However, charging some of these weapons sometimes requires an unjustifiable expenditure of force.

DETAILED DESCRIPTION

The present disclosure relates to example handguns, such as multiple-shot handguns, that can fire electrically ignitable cartridges and which have an electric circuit for the generation of the ignition voltage, a breech block and a firing pin held in the breech block, whose ignition tip rests on the cartridge bottom of a loaded cartridge when the breech block is closed. The example weapons described herein also have a swiveling contact lever whose swiveling movement is coupled with the movement of the breech block, and which is in electrical contact with the firing pin and the electric circuit. Further, the contact lever is designed in such a way that the contact lever interrupts the electrical contact between the electric circuit and the firing pin when the breech block is open.

Throughout this description, position designations such as "above," "below," "top"" "forward," "rear," etc. are referenced to a firearm held in a normal firing position (i.e., pointed away from the shooter in a generally horizontal direction). Furthermore, the normal firing position of the weapon is always assumed, i.e., the position in which the barrel or muzzle is pointing to the front, the axis of the bore runs horizontally and the normal axis of the weapon is held vertically.

Figure 1:
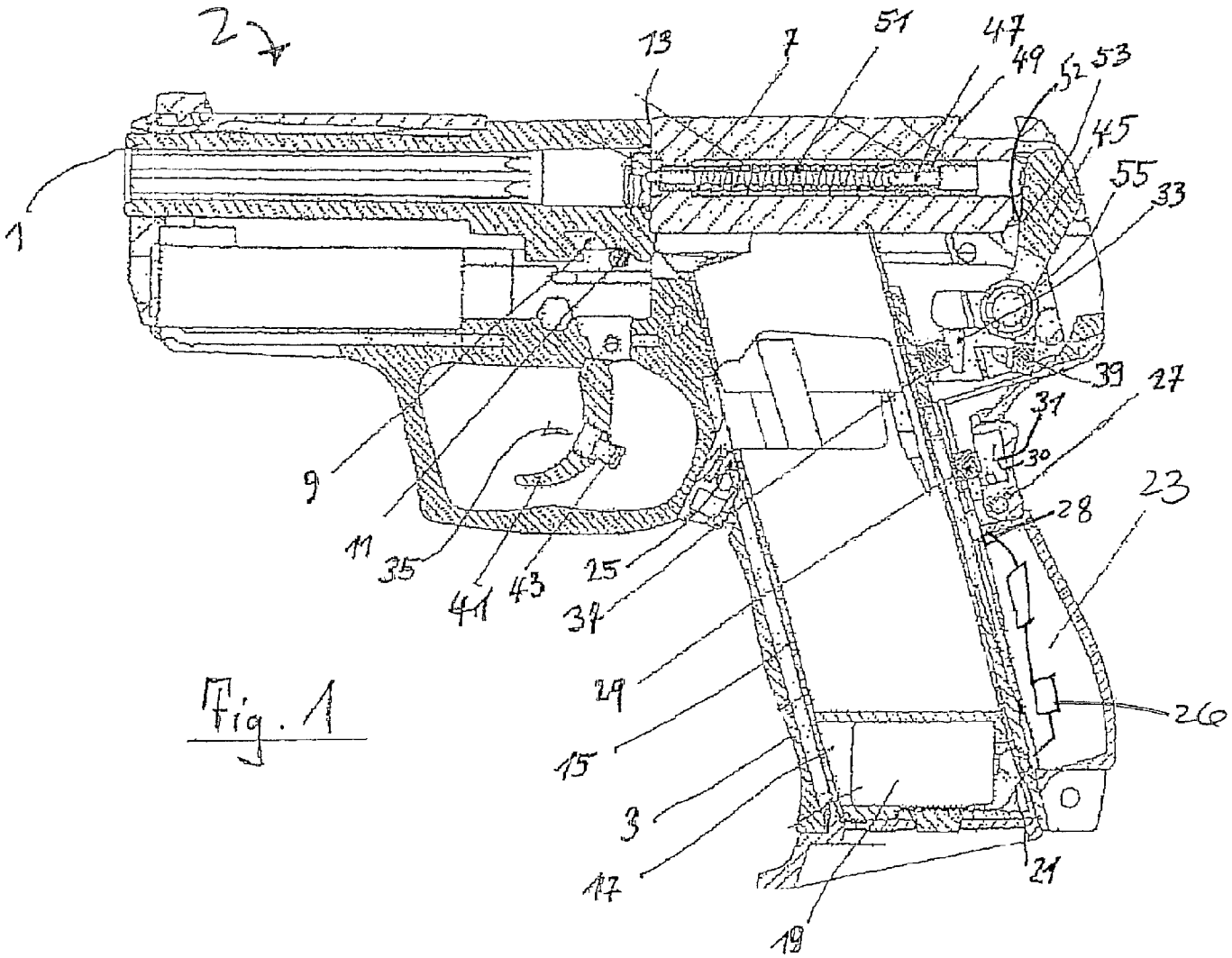
FIG. 1 shows a cross-sectional view of an example electronically ignitable firearm, with example electronics shown in block form.

As shown in FIG. 1, the example firearm 2, which may be a pistol or any other firearm, has a barrel 1, which is loosely supported in a grip 3 so that the barrel 1 may retract to the rear a certain distance and/or tilt when a shot is fired. The top side of the barrel 1 is coupled to an ejector window 5 of a breech block 7, while the underside of the barrel is coupled to a diagonal groove 9 that extends to the bottom and through which the barrel 1 engages, during rearward movement, a stationary cross pin 11, which is pulled to the bottom of the barrel 1 and secured there.

The rear side of the barrel 1 is locked by a face 13 of the breech block 7 as long as the barrel 1 is in horizontal position. After the tilting of the barrel 1, the breech block 7 is released and, after having been initially accelerated by the recoil, the breech block 7 moves to the rear of the firearm 2.

The grip 3, which may also accommodate the cross pin 11, includes a magazine 15. It is from the magazine 15 that the breech block 7 receives an upper cartridge (not shown) and feeds the upper cartridge into the barrel 1 as the breech block 7 is closing, after the return motion described above.

In some examples, the magazine 15 and the grip 3 may be of a conventional and standard length, but the underside of the magazine 15 may also include a recessed space 17, which may decrease the number of cartridges that may fit into the magazine 15. The decreased number of cartridges (which may be in staggered storage, for instance) may be, for example, only ten cartridges which, in the U.S., is the highest permitted number of cartridges for small arms that are not government issue weapons. Because of a typical hand size of a marksman, the recessed space 17 may be included so that the length of the grip 3 is appropriate and useful. In some example firearms, the recessed space 17 may be left empty or filled with a massive block. However, in the example firearm 2 illustrated in the figures, the recessed space 17 includes a battery 19 or power supply unit (e.g., accumulator, etc.) with a specified output voltage (e.g. 6 V). Furthermore, below the rear side of the magazine 15, at least one contact spring 21, which is insulated from the magazine 15, protrudes. Because the magazine 15 includes non-conductive plastic, there may be two contact springs 21 to conduct electric power from the battery 19 (though only one shown in the figures).

The magazine 15 may be designed as a disposable magazine that comes supplied loaded with ammunition and which is discarded after use. Further, the recessed space 17 in the magazine 15 also may be accessible, and the battery 19 may be interchangeable.

However, when the battery 19 is interchangeable, the marksman should make sure that the battery 19 always has sufficient residual current for the emission of at least ten shots. To ensure that there is sufficient power to properly operate the firearm 2, the marksman may insert a magazine with a new battery prior to each use. Replacing batteries to ensure sufficient power supply is a solution known in other applications such as with cameras. With cameras, the solution of inserting new batteries (e.g., prior to an important photo deadline) has proved satisfactory enough for the camera industry as there are hardly any cameras being sold that include a mechanical solution to providing batteries with sufficient power supply.

However, many weapons, particularly military pistols, are exchanged after a few decades of use for example if a particular portion or component has worn out even though, until the occurrence of signs of wear and tear, often only a few shots have been fired. The weapons may experience wear and tear or other damages though only a few shots have been fired while the weapon was deployed in the military because, perhaps, prior frequent and relentless use during training or in guard duty may have caused damage. Also, in the case of civilian weapons, it may be desirable that a weapon does not outlive its owner because after the owner's death, a legally acquired weapon may fall, unchecked, into unauthorized hands. Consequently, it also may be preferred that the battery 19 in an undamaged magazine 15 may not be exchanged, while such battery 19 also is equipped such that the battery 19 survives (i.e., is usable) for decades and through several tens of thousands of shots. The recessed space 17 is large enough to hold such a battery 19 because while it is true that the ignition of a cartridge requires energy, this energy must only be provided for a very short time such as, for example, some milliseconds. Batteries with such an energy storage capacity are available today.

In conventional mechanical pistols (i.e., pistols without electronic ignition), a powerful firing pin spring is usually located in the rear side of the grip. However, in the illustrated example firearm 2, the rear side of the grip 3 opposite the contact spring 21 includes a grip space 23. The grip space 23 also includes electrical opposing contacts 28 (shown in block diagram form) that promulgate a flow of current with the contact springs 21 of the magazine 15. A conventional magazine holder 25, which holds the magazine 15 firmly in its position during use of the firearm 2 and guarantees a clean loading of the cartridges, also provides for a constant and clean current conduction from the contact springs 21 to the opposing contacts 28.

The grip space 23 also houses electronics 26 of the firearm 2. In the illustrated example, the electronics 26 are shown in block diagram form and may include many types of electrical components used to perform the functions described herein. Further the term electronics 26 may be understood to include other electrical components detailed throughout this description including those components designated as "electric circuit." The electronics 26 are producible by an experienced electrician or engineer and include structure that is used to increase the voltage of the battery 19 to a considerably higher value. Circuitry to increase the value of a voltage is known in other applications such as door opening devices or an electronic flash. Further, in some examples, the electronics 26 may be designed with identification devices such as, for example, identification devices that are included in the receiver of the firearm 2 and are operatively coupled (e.g., via communication links) only with a transmitter that may be located in an armband that is worn on by the marksman on the arm of the hand holding the firearm 2. The identification device and communication with a specific transmitter ensures that an unauthorized person with a different armband (i.e., transmitter) will not be able to fire any shots with the firearm 2, even if the voltage in the battery 19 is sufficient to fire a shot.

The electronics 26 also are designed so that current surges can follow each other briefly. This ensures when the firearm 2 locks after the firing of a shot, there is also enough current available for the triggering of the next shot.

A grip safety 27 with a grip safety pushbutton switch 29 is arranged above the electronics 26. The grip safety 27 is seated in the location of most conventional grip safeties and ensures that the grip safety 27 may only be closed when the firearm 2 is properly enclosed or grasped by a hand of the marksman. The grip safety 27 may be of any design and, for instance, may be extended upward by an extended spur (not shown) to prevent the hand from being injured by the breech block 7 when the breech block 7 is returning or otherwise moving. In the illustrated example, a massive arm-rocker lever 30 is arranged underneath the area of the breech block 7, which is pressed to the rear by a spring (not shown) and which contains a release spring 31. The release spring 31 contacts the pushbutton switch 29 when the arm-rocker lever 30 is completely compressed.

Some mechanical grip safeties do not enable a weapon into which they are incorporated to be cocked until actuation of the grip. Such grips may require only an extremely slight expenditure of force for the actuation. In the present example, the grip safety 27 may be used to prevent operation of the firearm 2 as well. More specifically, the pushbutton switch 29 of the grip safety 27 does not simply function as a mechanical switch that disables use of the weapon by interrupting the ignition voltage similar to a trigger safety. Instead, the pushbutton switch 29 of the grip safety 27 emits a signal to the electronics 26 that causes a transformer circuit part to generate a sufficient ignition voltage from the battery voltage when the pushbutton switch 29 is pressed. This ignition voltage is available, for a period of time, for example 10 milliseconds, after actuation (closing) of the pushbutton switch 29. The ignition voltage is interrupted when the pushbutton switch 29 is opened, i.e., when the grip safety 27 is no longer sufficiently secured under the hand of the person operating the firearm 2. Thus, as stated above, the grip safety 27 may be used to disable the firearm 2.

With disposable magazines and/or interchangeable batteries, the battery capacity required, even for as little as ten shots, is irregularly large. Furthermore, a weapon may be grasped by a marksman ready to fire for some period (even an extended period of time) prior to the actual discharging of a shot. Consequently, an empty (e.g., completely spent) magazine or a magazine specially design for practice, which includes no battery and no cartridges, may be use for firing position drills or other practicing.

A release piece 33 is located above the grip safety 27 and the pushbutton switch 29. The release piece 33 is coupled via a light rod (not shown) to a trigger 35. The release piece 33 moves to the front when the trigger 35 is pulled and moves to the rear when the trigger 35 is released. In FIG. 1, the release piece 33 is in the trigger position, while the trigger 35, on the other hand, is in the release position (to show the individual parts more closely, though in practice such a position is not possible). The rod corresponds to the rod of a conventional (mechanical) pistol, but only the force associated with a trigger spring (not shown) needs to be overcome to build up the required resistance to actuate the trigger 35 and discharge a shot. The rod itself actuates in each of its two end positions a micro switch, i.e., a trigger detection switch 37 and a circuit breaker 39.

In addition, there is an elastic thrust piece 43 that is integrated in a trigger blade 41 of the trigger 35. The thrust piece 43 does not impair the front contour of the trigger blade 41 but, rather, is directed to the rear to rest against the grip 3 when the trigger blade 41 has been pulled. The initial stages of operation of the trigger 35 (i.e., at the beginning of movement of the trigger 35) are known as the "trigger slack" in which the force required to move the trigger 35 is relatively smaller than the force required as the trigger moves to the rear (and the thrust piece 43 contacts the grip 3), as described below. Shortly after the trigger slack, the trigger 35 must overcome a simple limitation of the trigger path (i.e., a so-called "trigger stop"), which may be force from, for example, a compression spring (not shown) included with the thrust piece 43. When the thrust piece 43 engages the grip 3, the compression spring cause a sudden increase in the force required to further actuate the trigger ("trigger force"), especially compared to force encountered during the trigger slack. The trigger 35 and trigger blade 41 continue to be moved a short distance under the increased trigger force until the rod (not shown) rests the release piece 33 against one of the micro switches 37, 39 (for example, the trigger detection switch 37) and the micro switch 37, 39 closes upon detection of actuation of the trigger 35.

The other of the micro switches 37, 39 (for example, the circuit breaker 39) is actuated upon the release and/or complete movement forward of the trigger 35 and the trigger blade 41 and must be actuated if the trigger detection switch 37 is to be active and have current supplied to it.

Figure 2:
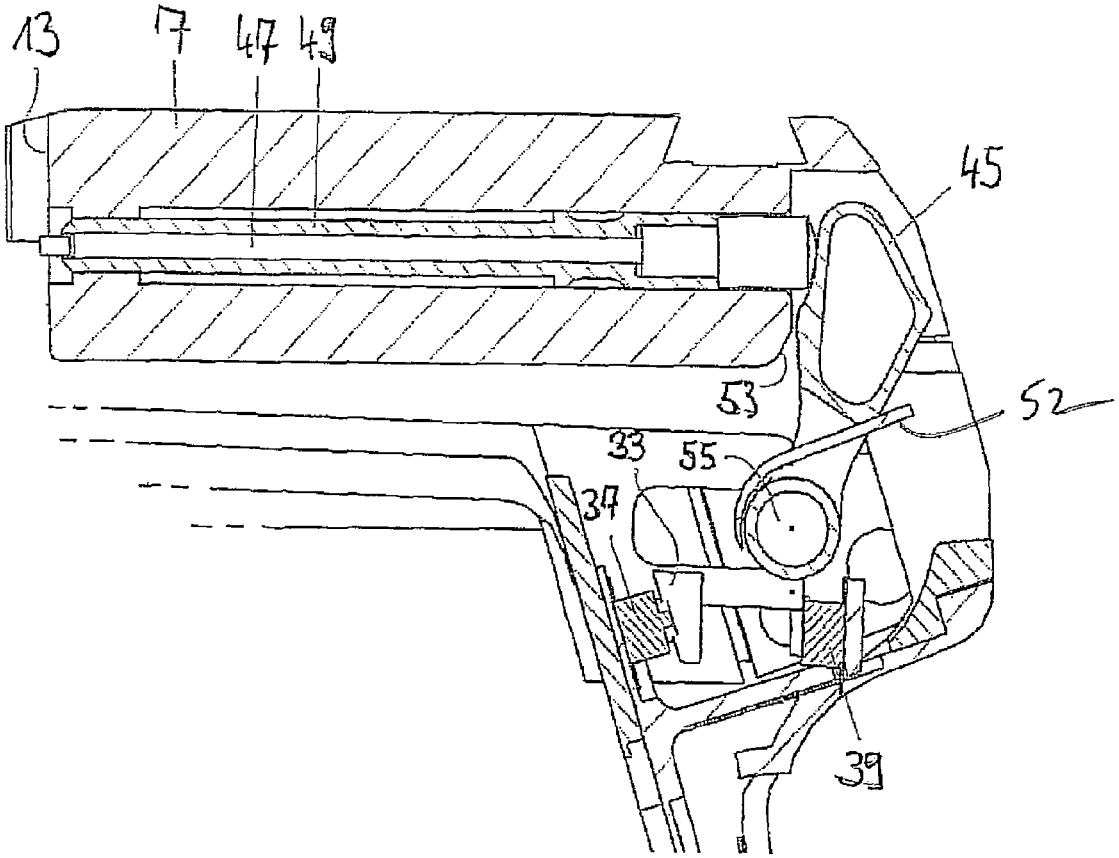
FIG. 2 is an enlarged view of a section of the example firearm of FIG. 1 showing an example contact lever and example electric points of contact.

The example firearm 2 includes a contact lever 45, which is shaped similar to a hammer, and like a hammer, the contact lever 45 is brought into a cocking position by the breech block 7. However, the contact lever 45 does not remain in this position but, rather, moves to the front again after each shot. At the end of the movement of the contact lever 45 and not until the breech block 7 is completely closed, the contact lever 45 loads a firing pin 47, which is then pressed out a little from the face 13 of the breech block 7. Furthermore, the contact lever 45 is provided with a powerful torsion spring, the contact lever spring 52 (FIG. 2), similar to what is used with clothespin springs, which presses the contact lever 45 forward. The contact lever spring 52 has no influence on the trigger 35, which also has no catching or other resistances to overcome, though such resistances are necessary in the functioning of conventional, mechanical pistols.

The firing pin 47 is narrowly enclosed by an insulation sheath 49, which may be firmly coupled to the firing pin 47 or alternatively to the breech block 7. In addition, the sheath 49 surrounds the firing pin 47 over its entire length. Further, a relatively weak firing pin spring 51 presses the firing pin 47 to the rear.

Figure 3A:
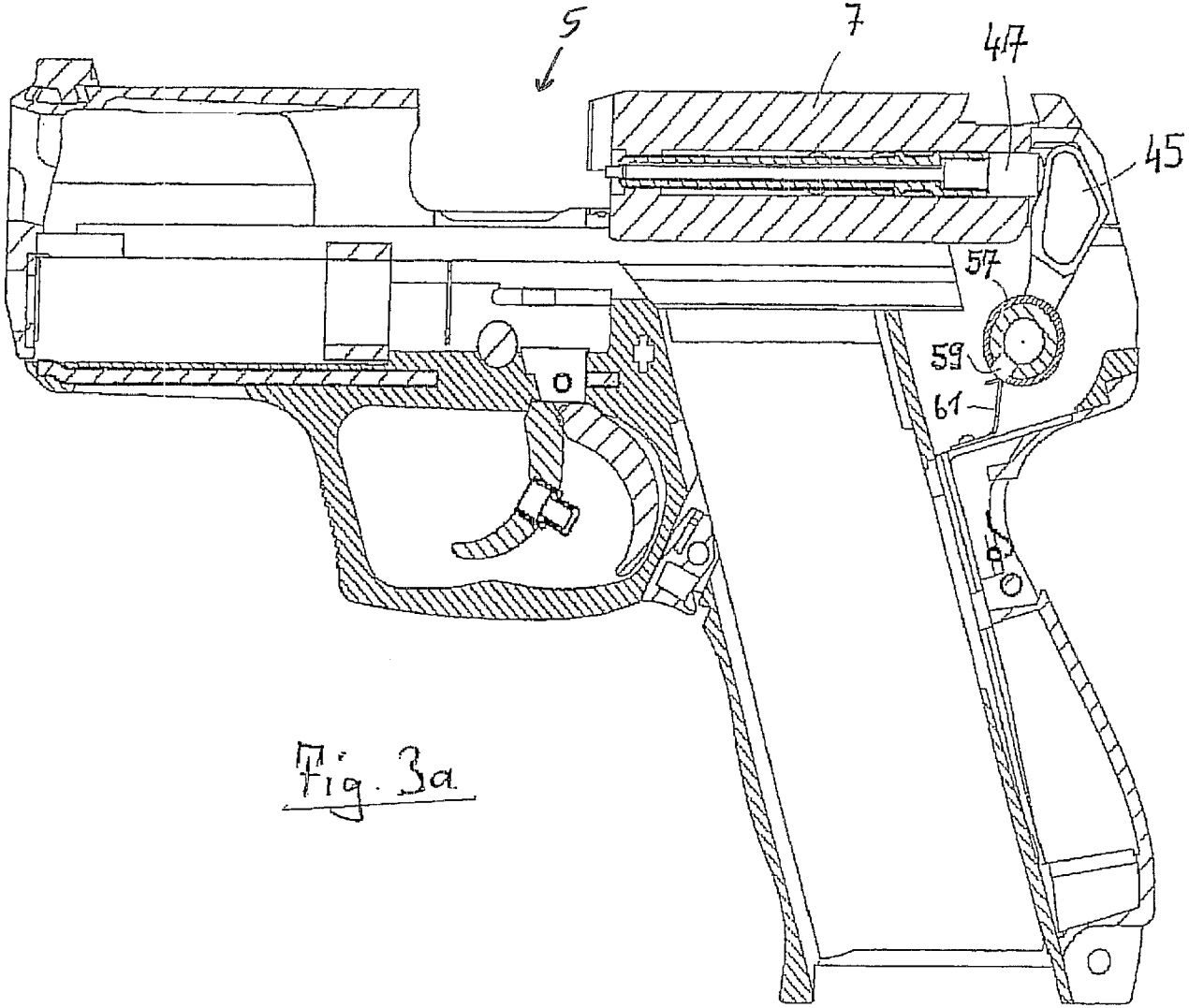
FIG. 3*a* is a cross-sectional view showing the example firearm of FIG. 1 with the example contact lever, an example breech block and an example firing pin positioned to form a closed circuit.
Figure 3B:
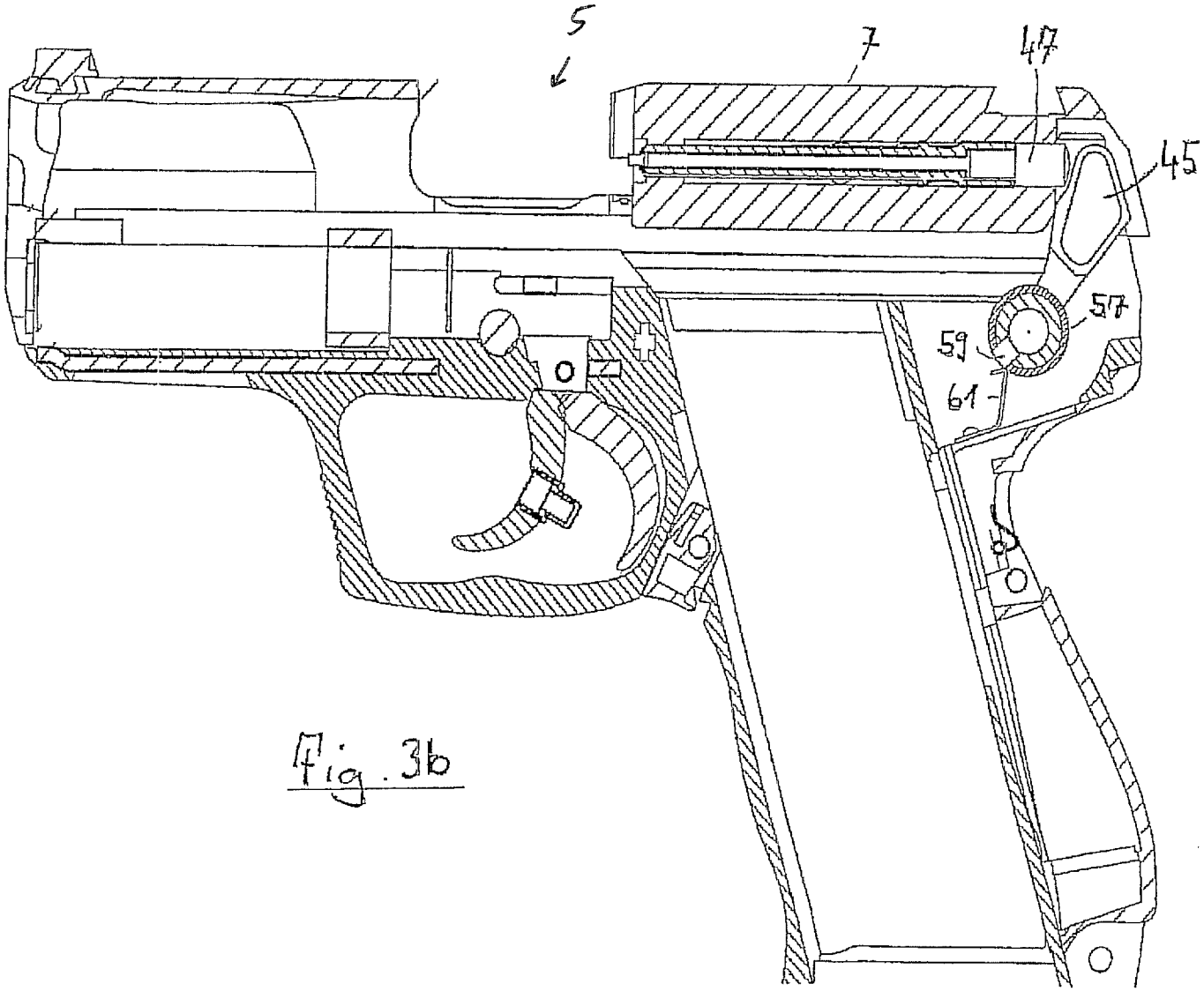
FIG. 3*b* is a cross-sectional view showing the example firearm of FIG. 1 with the example contact lever, breech block and firing pin positioned to form an open circuit and a short circuit.

When a shot is fired, the recoil from the shot drives the breech block 7 and the barrel 1 to the rear until, as described above, the barrel 1 tilts and, in the process, releases the breech block 7, which returns alone all the way to the rear. At the beginning of the joint backward movement of barrel 1 and breech block 7, an edge 53 of the breech block 7 engages the contact lever 45 and begins tilting the contact lever 45 to the rear, as shown in FIG. 3*b*. In the process, the contact lever 45 lifts from the firing pin 47 so that the firing pin 47, driven by the firing pin spring 51, may move a bit to the rear, opposite the breech block 7. Thus, the ejection of the cartridge case and the loading of the new cartridge take place unhindered because the firing pin 47 no longer protrudes from the face 13 of the breech block 7.

The contact lever 45 is pivoted on a swivel axis 55. The exterior of the contact lever 45 is electrically insulated (at least in the region of the swivel axis 55) to the greatest extent by an insulating ring 57, which is not completely circular. There is a gap in the insulating ring 57 that forms a precisely arranged point of contact 59 that electrically conducts outward. The point of contact 59 cooperates with a sliding contact 61 (FIGS. 3*a* and 3*b*) in such a way that the point of contact 59 is only electrically conductively coupled to the sliding contact 61 when the contact lever 45 is located in its swiveling position so that the insulating ring 57 does not contact the sliding contact 61, which is when the breech block 7 is closed and the firing pin 47 is pressed out of the face 13 of the breech block 7 by the contact lever 45 (e.g., FIG. 3*a*). In all other swiveling positions, the circuit is interrupted because there is no coupling of the contact point 59 and the sliding contact 61 (e.g., FIG. 3*b*).

In addition or as an alternative to the above-described configuration in which the contact lever 45 is formed and/or positioned with its end engaged with the firing pin 47, the sliding contact 61 and the point of contact 59 may be formed in other variations. For example, the firing pin 47, when the breech block 7 is moving to the rear, may not be engaged by the contact lever 45 (distinct from what is illustrated in FIG. 3*b* where the contact lever 45 is decoupled from the firing pin 47 by the breech edge 53). In this configuration, there is no longer an electrical connection between the firing pin 47 and the contact lever 45. Not until the breech block 7 is closed again does the contact lever 45 engage upon the firing pin 47 and press the firing pin 47 forward (as shown in FIG. 3*a*). If the example firearm 2 is insufficiently locked or not locked at all, then the breech edge 53 prevents the contact lever 45 from engaging the firing pin 47. Additionally, before the contact lever 45 is disengaged from the firing pin 47, the rear section of the breech block 7 may come into electrical contact with the firing pin 47 either directly or indirectly. Such contact may occur, for example, via the contact lever 45 which, when the breech block 7 is returning, engages both the firing pin 47 and the breech block 7 for a short time. Consequently, the electrical circuit is shorted or closed, completing the electrical connection through the contact lever 45 and the firing pin 47 to the cartridge bottom and from the cartridge through the breech block 7 back to the electronics 26. Thus, for the purposes of ignition of a loaded cartridge, the required ignition voltage stored in a capacitor in the battery 19 may be rapidly discharged.

The electronics 26 may emit only one single current surge, after the emission of which the trigger 35 must again be released to the front. Once the trigger 35 has arrived in its front most position, the release piece 33 contacts the circuit breaker 39, and the circuit breaker 39 puts the electronics 26 into a state in which the electronics 26 prepare sufficient voltage and current for a second shot, provided the pushbutton switch 29 of the grip safety 27 remain pressed. Thus, prior to the firing of each shot, the circuit breaker 39 is to be actuated. Therefore, among the other safety features detailed herein, requiring the actuation of the circuit breaker 39 prevents a shot from being discharged even if when the trigger 35 is pulled and weapon is charged.

The force required to actuate the trigger 35 (i.e., the "trigger weight") is only predefined by the trigger spring and the thrust piece 43 and may be freely selected within reasonable limitations. There is no break or rest to be overcome. Further, the contact lever 45 may be light because the force with which the contact lever 45 engages the firing pin 47 is given by its torsion spring alone. The firing of a shot occurs more rapidly after the triggering of the example firearm 2 than with a conventional, mechanical weapon because with mechanical weapons, a released hammer still has to cover its striking path, while with the example electronically ignited firearm 2, ultimately the electronics 26 and the trip voltage determine when the shot occurs. Also, in the illustrated firearm 2 with the electronic ignition, there is no hammer momentum to disturb aiming or other the shooting accuracy because only a relatively light contact lever 45 is present. Further, the contact lever 45 has been stopped at the time of release for a relatively long period of time; therefore, no load moment occurs (or the load moment is very slight).

While the triggering voltage is rather high (about, for example, 60 Volts), the voltage is however harmless because the voltage is only present for a short time. Thus, the contact lever 45 may also be uninsulated, regardless of the ranges of contact between the contact lever 45 and the sliding contact 61. Further, the voltage is harmless for other reasons, namely because the contact lever 45 only receives a current surge when the firearm 2 is currently being fired. Thus, to come into contact with the voltage, a person would have to have his or hand positioned directly behind the contact lever 45 at the time firing. In this position, the person would first be injured by the returning breech block 7 and not the voltage.

Figure 4:
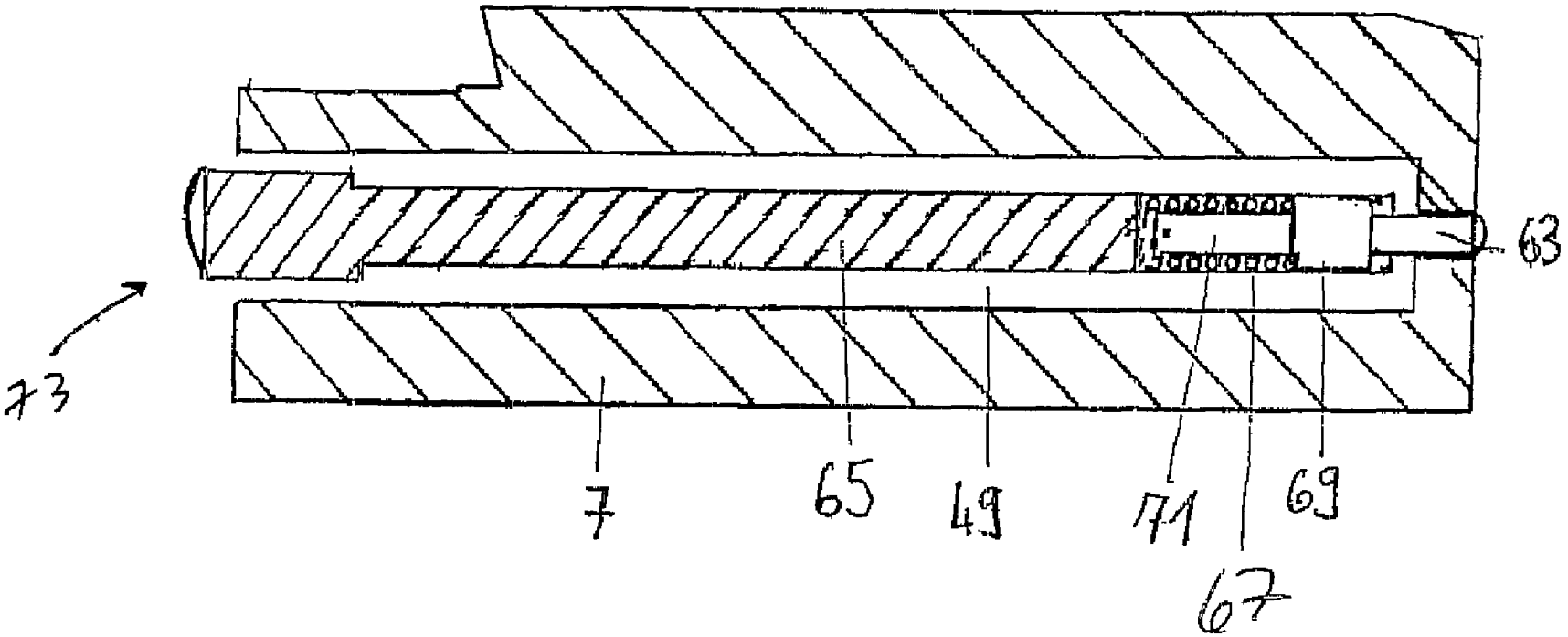
FIG. 4 is a cross-sectional view of an alternative example firing pin.

FIG. 4 (in which the "front" of the firearm 2 is toward the right) shows an alternative example firing pin 73, which is designed in two parts. The example firing pin 73 includes a front tip 63 that is engageable with a cartridge bottom and a rear base rod 65 that is engageable with the contact lever 45. The front tip 63 and the rear base rod 65 are coupled to each other in a longitudinal direction via a cylindrical spiral spring 67. The spiral spring 67 is supported on the front end of the base rod 65 and on a projection 69 of the tip 63. The projection 69 is guided with a tail 71 a specified length into the cylindrical spiral spring 67. This length is dimensioned so that the tail 71 serves as a path limitation for the movement of the tip 63 into the breech block 7. The mass ratio between the base rod 65 and the tip 63 is such that when the tip 63 hits the cartridge bottom (e.g., when the breech block 7 is moving forward) the weight of the tip 63 has no affect on the momentum of the rear base rod 65 or only creates a negligible effect. For example, the mass ratio may be at least 5 to 1, or in other examples, 8 to 1. Correspondingly, the spring constant of the spiral spring 67 is selected so that the impulse during impact of the tip 63 on the cartridge bottom is essentially absorbed by the tip 63 and, thus, not transferred to the base rod 63. The spring constant is also selected so that when the tip 63 is engaged with the cartridge bottom, a sufficient contact pressure is still maintained and guaranteed for the electrical connection. Further, when the breech speeds are, for example, 3-4 m/s, the mass of the tip 63 is, for example, 1 g, and the weight of the rear base rod 65 is, for example, 8 g, a spring constant of 1 N may be used.

In the example shown in FIG. 4, the firing pin 73 also may be axially fixed with respect to the breech block 7, i.e., not permitting any relative movement in axial direction with respect to the breech block 7. Because the weight of the breech block 7, which is, in this example, firmly coupled to the base rod 65, is added to the weight of the base rod 65, essentially only the mass of the tip 63 and the spring constant are selected to ensure that the impact shock is sufficiently absorbed. Thus, the values of the mass of the tip 63 and the spring constant are relatively and sufficiently low. However, the values of the mass of the tip 63 and the spring constant are still great enough to ensure the required contact pressure to complete the electrical connection and ignite the cartridge.

One of ordinary skill in the art would appreciate that the example firearm 2, which may be, for example, a multiple-shot handgun, includes an electric ignition whose function is safer than the conventional weapons described above. In particular, the example firearm 2 includes the swiveling contact lever 45 whose swiveling movement is coupled with the movement of the breech block 7, and which is in electrical contact with both the firing pin 47 and with the electronics 26. The contact lever 45, as described above, is designed in so that the contact lever 45 interrupts the electrical contact between the electronics 26 and the firing pin 47 when the breech block 7 is opened. Furthermore, the structure of the example firearm 2 may be designed so that the firearm 2 does not substantially differ in exterior appearance and in general operation (in terms of the number of shots that may be fired) from a conventional weapon.

The contact lever 45 is similar to a hammer and is swiveled back from a forward position, as the breech block 7 just begins to open. With slight further swiveling movement of the contact lever 45 as the breech block 7 moves only a little to the rear, the contact lever 45 interrupts the circuit to the firing pin 47. Thus, the ignition contact is interrupted even before the weapon 2 has released.

Similar to the designs of a "hammerless" pistol or a semi-automatic weapon, the contact lever may lie within the firearm 2, but the firearm 2 also may be open toward the rear, which would reduce the overall length of the firearm 2. However, because the contact lever 45 does not need to be under tension, the contact lever 45 does not have to be accessible by hand. Thus, the contact lever 45 may be disposed within a longitudinal slot on the rear side of a slide of the firearm 2, from which the contact lever 45 only emerges during the reloading operation. Therefore, unlike a conventional hammer weapon, the example firearm 2 does not have a projecting part (the hammer) on which the weapon could get caught when being drawn or being used.

Because the flow of electric current is produced through the contact lever 45, there are no sliding contacts associated with the firing pin itself 47. Consequently, there can be no damage to any sliding contacts when the firearm 2 is taken apart because the contact lever 45 is located in the grip portion of the case of the firearm 2 and remains in the grip portion of the case, like a hammer would in a conventional weapon, when the firearm 2 is taken apart. In addition, the firing pin 47 itself may be electrically insulated with regard to the firearm 2.

One of ordinary skill in the art would appreciate that there are alternative examples in which the contact lever 45 may be formed such that the contact lever 45 engages the firing pin 47 in such a way that the firing pin 47 is not touched by the contact lever 45 when the breech block 7 is moving to the rear, which may eliminates any direct electrical connection between the contact lever 45 and the firing pin 47. However, preferably the contact lever 45 is pivoted on the swiveling axis 55, as described above. The exterior of the contact lever 45 in the region of the swiveling axis 55, there is the electrically conductive point of contact 59 is provided that cooperates with the sliding contact 61 in such a way that the point of contact 59 is only in electrical connection with the sliding contact 61 when the contact lever 45 is swiveled to the position associated with a closed breech block 7.

In addition or as an alternative to the sliding contact 61 discussed above, the current in the circuit may run through a first route between a loaded cartridge and the electronics 26 both via the firing pin 47 and the contact lever 45. Thus, the contact lever 45 may cooperate with the breech block 7 in such a way that when the breech block 7 is opening, the circuit is shorted via the contact lever 45. In this example, there are no long signal lines, which are susceptible to frequent and easy failure. On the other hand, the current in the circuit may run via the breech block 7. In this additional or alternative example, the contact lever 45 and firing pin 47 may be designed in such a way that when the breech block 7 is opening, the electrical contact between contact lever 45 and firing pin 47 is interrupted.

So the firing pin 47 does not impair the reloading operation, the firing pin 47 is preferably axially movable opposite the breech block 7 between two positions. In the first position, the ignition tip of the firing pin 47 protrudes from the face 13 of the breech block 7, and in the second position, the ignition tip of the firing pin 47 does not protrude from the face 13 of the breech block 7. The firing pin spring 51 pre-stresses the firing pin 47 into the first position.

Preferably the contact lever 45 engages the rear end of the firing pin 47 when the breech block 7 is closed and is pre-stressed against the rear end of the firing pin 47 by the contact lever spring 52 whose elastic force is greater than that of the firing pin spring 51. Hence, the contact lever 45 is loaded to the front by a spring like a hammer so that after every loading operation, the contact lever 45 impacts powerfully on the firing pin 47 (and, in the process and if necessary, removes oxide adhesion, dirt etc.) and forces the firing pin 47 out, against the force of the firing pin spring 51, from the breech bottom edge 53. However, there are catches (which often become contaminated or break) associated with the contact lever 45, as seen with weapons with a conventional hammers. Thus, complications with the triggering or discharging of a shot due to a catch disturbance are not possible with the example firearm 2.

In some examples, the electric circuit 26 has a trigger detection device (e.g. in the form of a pushbutton switch or other proximity sensor) coupled with the trigger 35 that activates the electric circuit 26 when the trigger 35 is pulled. The trigger 35 has, accordingly, only a simple "trigger" that triggers the shot so that the shot may be triggered without delay. The release time of the shot in this example is shorter than in the case of a conventional pistol wherein after the trigger is actuated, the movement of the hammer or firing pin requires an amount of time that is longer than the time required for heating resistance in the electrical cartridge to a point the cartridge discharges.

The electric circuit in the illustrated examples may require a certain amount of time to restore the readiness of the ignition to fire another shot. The time to restore readiness of the ignition may be set to be longer than the amount of time required for reloading another cartridge. Further, the flow of current to the contact lever 45 may be designed to be interrupted or not, depending on whether single-fire or bursts of fire are to be shot. The restoration time of the ignition state also may be adjustable so that a cadence of continuous fire may be reduced or otherwise adjusted as desired. Thus, a continuous fire with a cadence of, for example, 150 shots per minute, is possible even in firearms without shanks. Therefore, a relatively precise continuous fire may be sustained, when for example an opponent is to be kept in cover. However it also is preferred that the electric circuit 26 has a release detection device (e.g. in the form of a pushbutton switch or other proximity sensor), which is activated in the electric circuit 26 only when the trigger 35 has been released.

As described above, the example firearm 2 also includes two principally mechanically operated components, in particular the pushbutton switch 29 of the grip safety 27 and the trigger release device 33. The pushbutton switch 29, as described above, must be actuated for the trigger 35 to be pulled, while the trigger release device 33 is coupled to a rod (not shown) that engages, at either end, the two micro switches 37, 39. One of the micro switches serves as the trigger detection switch 37, and the other serves as the circuit breaker 39. Further, it is possible to make the function of the firearm 2 simple and clear so that conventional weapons mechanics also may repair failures. Finally, with respect to manufacturing defects, it is not necessary to change the entire electric circuit or electronics 26 for each affected weapon, but rather it suffices to replace the corresponding element—the pushbutton switch, the trigger release device 33, the trigger detection switch 37, the circuit breaker 39, etc. Moreover, the components discussed herein (e.g., the micro switches 37, 39) may be positioned in a portion of the firearm 2 where the components may be reached by a rod (not shown) and coupled, directly or indirectly to the trigger 35 such that only very short line or communication paths are created, which cannot or can hardly be reached (e.g., when cleaning) and thus, also may not be damaged.

As stated above, the trigger 35 is coupled to the rod, which leads to the rear and which includes actuating means to activate the trigger switch and the circuit breaker. As a result, not only is an advantageous combination of mechanical and electrical features achieved, but rather the electric devices are also concentrated in the region of the contact lever 45 that other regions may be filled, for example, with the magazine 25. In addition, the rod does not have to perform additional swivel movements, as in the case of breakers in conventional pistols. Rather, the rod only has to perform a simple forward and rear movement; therefore, compared with conventional pistols, one source of error in operation of the weapon is eliminated. That is, the illustrated example firearm 2 does not include a rod that has two-dimensional mobility and, thus, there are fewer difficulties that may occur with the rod of the present example firearm 2.

Furthermore, the rod also may be made of plastic because the rod only has to transmit information (e.g., the opening and closing of the pushbutton switch 29). The rod does not have to transmit forces such as the tensile force that occurs with the cocking of a conventional hammer during a trigger cocking operation. Further, the trigger spring (not shown) is arranged on the trigger 35 (not on the rod), which guides the released trigger 35 back to the front position. The rod, therefore, follows the trigger 35 forcibly, though the rod is unloaded by the movement of the trigger 35, which is pressed forward by the trigger spring.

When the trigger 35 is pressed forward by the trigger spring, the trigger 35 may be moved against the force of the trigger spring to the rear until ultimately the shot fires. However, it is preferred that the thrust piece 43, which is directed to the rear, be arranged in the blade 41 of the trigger 35. When the trigger 35 is first actuated, the thrust piece 43 only enables the trigger 35 to be moved over a certain initial distance until the thrust piece 43 engages the grip 3. Thereafter, the trigger 35 may be actuated a short distance further but under increased elastic force from the thrust piece 43. Thus, the thrust piece 43 serves to set the precise attachment of the trigger 35 and the components (e.g., the trigger release 37 and circuit breaker 39), which therefore, may be mounted firmly and without possibility for adjustments. In addition, the thrust piece 43 also provides trigger slack, that is, the increase of the trigger force immediately before the firing of the shot. In some examples, the amount of force needed to actuate the trigger 35 and/or the length of the path of the trigger 35 after the thrust piece 43 engages with the grip 3 (i.e., after reaching the trigger slack) may be set by, for example, a rotation of the thrust piece 43 within a tapped hole (not shown) in the trigger blade 41. If the weapon, for instance, falls into mud, the trigger device may be immediately rendered completely operable once again by simply wiping behind the trigger.

As stated above, in some examples, the distance of the trigger actuation to the beginning of the increased spring force is adjustable so that it can be selected whether the trigger slack begins later or earlier after the start of the trigger actuation. Thus, in these examples, it is also selectable whether a shot is triggered immediately or not until after a further pulling of the trigger 35 (e.g., after reaching the trigger slack).

In addition, the spring force and the hardness of the trigger slack also are preferably adjustable. Adjustment of the level of the spring force and/or trigger slack do not require the firearm 2 to be taken apart, but rather may be performed, for example in minutes, by a weapons mechanic by, for example, adjustment of the thrust piece 43.

As stated above, the example firearm 2 includes the battery 19. In the simplest example, the firearm 2 would include a battery that has sufficient voltage for ignition of a cartridge. However, the example firearm 2 has the electric circuit that includes the battery 19, which has an output voltage that is lower than the voltage required for triggering a shot, and a transformer circuit that transforms the output voltage of the battery 19 to the voltage required for triggering a shot. Thus, it is highly improbable that an accident, for instance the driving of a tank over the weapon, which could produce contact to complete the circuit to fire a shot, actually triggers a shot. Furthermore, the use of the transformer is important with weapons that include individualized safeties because though an authorized person may bridge the electronics, this bridging does not suffice to trigger a shot.

Preferably the electric circuit 26 has an identification device for identification of the marksman holding the firearm 2, wherein the identification device activates the electric circuit 26 after identification of the marksman. The identification device may be in one of many forms, including, for example, a receiver in the firearm 2 that is communicatively coupled to a transmitter or other electrical device positioned on the wrist of a marksman, so long as the identification device is able to put the electric circuit 26 in and out of readiness.

In addition or alternative to an identification device, the example firearm 2 may also include a switch with which the firearm 2 will be activated immediately before the firing of a shot such as, for instance, a safety. A separate safety switch may be preferable when it is not desirable to have a weapon that is always ready to be fired just because the weapon is loaded and taken in hand by an authorized marksman. Thus, in some examples it is preferable that the electric circuit 26 has a safety switch that must be actuated to activate the electric circuit 26. The safety switch allows the electronics 26 to be switched on so that the electronics 26 may be used to hold the transformed or high-tension voltage ready. Further, in the case of non-actuation, the safety switch may cause the electronics 26 to reduce the transformed or high-tension voltage without delay, at least to an extent that triggering of a shot is no longer possible with the reduced voltage. The safety switch is, thus, not a simple switch that is electrically upstream from the contact lever 45 and, for instance, sits in the breech block 7. Rather, when in the safety position, the safety switch may be used to discharge at least a portion of the voltage in the electronics 26 to the extent that the remaining current is no longer sufficient for igniting a shot, and only in the firing position is the ignition current again provided via the electronics 26. This does not change the state of the micro switches 37, 39 so that the firearm 2 may be loaded and carried with the safety on without danger. After the safety is released, only a very small amount of time, for example on the order of milliseconds, is needed to produce sufficient voltage and current so that the firearm 2 is ready to fire.

The safety switch may be one of a number of designs including, for example, a lever safety, a wing safety, or a compression safety. However, it is preferred that the safety switch is constructed as the above-described grip safety 27 with the pushbutton switch 29, which is associated with the grip 3 as described above.

The grip safety 27 may be arranged on the front side of the grip, like a cocking lever, which has been included in some of Heckler & Koch's earlier, mechanical pistols and provides for high security that exceeds the security offered by a traditional safety. However, it is preferred that the grip safety 27 and the pushbutton switch 29 are housed in the rear side of the grip 3, where the pushbutton switch 29 of the grip safety 27 may be actuated by the part of the hand of the marksman that encompasses the grip 3 and that lies between the thumb and the index finger, similar to known safeties such as, for example of the safety in the ACP pistol. One of ordinary skill in the art would appreciate that placement of the grip safety 27 in this position is advantageous because the firearm 2 is only ready to fire when the firearm 2 is taken properly into the hand of the marksman. In addition, placement of the grip safety 27 in this position is advantageous because with weapons, such as for example the firearm 2, with the magazine 15 in the grip 3, the pushbutton switch 29 of the grip safety 27 is seated behind the magazine 15 and, thus, in line with other components such as, for example, the micro switches 37 and 39 and the contact lever 45 so that simple and short line paths are present, which are less susceptible to failure than longer signal lines.

Preferably, the electric circuit 26 is arranged in such a way that the electric circuit 26 applies the ignition voltage to the contact lever 45 when the electric circuit 26 has been activated by the identification device, the safety switch 27 and temporarily and successively by the circuit breaker 39 and the trigger detection switch 37.

In the past, accommodation of a battery has been problematic. For example, the pistol described in WO 98/55817 proposes a magazine that is filled completely with electronics and a power supply. This magazine only looks like a magazine but no longer functions as such. Though it is definitely practical to easily remove a battery from the design of a pistol (e.g., the known mechanical pistols), removing the magazine, even if just by function, is more problematic because the magazine is basically required for the loading of cartridges. The example firearm 2 described herein, is able to combine both a functioning magazine 15 and the necessary electronics because the bottom side of the magazine 15 includes recessed space 17 that is used to house the battery 19. In other respects, the magazine 15 may be filled with cartridges, like a conventional magazine. Thus, the illustrated electrically ignitable self-loading firearm 2 includes enough cartridges in the magazine 15 that the number of shots is not significantly lower than what is included in a conventional pistol. In addition, the exterior dimensions of the example firearm 2 correspond substantially to those of a conventional pistol. Thus, with a government-issue weapon of this type, no training or at least only little additional training of the personnel equipped with the example firearm 2 may be necessary. In the ideal case, the marksman would not be aware of whether he is handling a mechanical or an "electric" weapon.

In addition, in the United States civil self-loading pistols may only have a supply of ammunition of ten shots. However, a grip that is geared to fit the predominant anatomy of a hand can hold a magazine with up to fifteen 9 mm cartridges. Thus, a magazine that designed for 9 mm cartridges would have space is available that may be filled with a rather large battery.

The battery 19 may be enclosed in the recessed space 17 in such a way that the battery 19 may not be removed easily. Preferably, one battery will suffice for the usable life of the firearm 2, which may be for example, ten years or so. However, as stated above, if a firearm 2 has been used frequently for firing position drills or the like (e.g., in the training of soldiers), after a certain amount of time a new magazine may be necessary. Thus, the battery 19 also may be interchangeable in some examples. However, it is preferred that the recessed space 17 may not be opened or accessed or only may be opened with a special tool, so that the contacts of the battery 19 are not damaged by frequent removal and insertion.

The contacts for the transmission of the current between the magazine 15 and the remainder of the firearm 2 may be mounted somewhere on the sides or the top side of the magazine 15. However, it is preferred that on the rear side of the magazine well, at least one contact 21 connected to the battery 19 is provided, with which the opposing contact 28 also arranged in the magazine well cooperates. Normally, the magazine 15 and the grip 3 will include substantially mostly plastic; however, in the illustrated example, there is also at least two electrically conductive contacts also. Furthermore, in other examples, several additional contacts also may be provided when the battery 19 or an arrangement of batteries may be used to supply multiple voltages.

Preferably the electric circuit 26 is seated in the rear side of the grip 3 and preferably in the grip space 23, or anywhere in the rear of the firearm 2 such as, for example, in a place (for a conventional pistol) where the firing pin spring extends with a firing pin spring centering rod. Furthermore, while the contact lever 45 also is pre-stressed by the contact lever spring 52, the contact lever spring 52 does not need to be as powerful as a conventional firing pin spring and is preferably designed as a torsion spring (like a clothespin spring, as discussed above), which is arranged around the shaft of the contact lever 45 and which supports itself on the case or on the contact lever 45. Thus, in the rear side of the grip 3, there is a space (FIG. 2) above the height of the magazine 15 which may be filled with many of the components of the firearm 2 including, for example, the contact lever 45, the trigger detection switch 37, the circuit breaker 39, the grip safety 27, and/or the electronics 26. Further, in some examples, the electric the current may flow from the front and the bottom through the electronics 26, the grip safety 27, the trigger detection switch 37 and circuit breaker 39, and then the contact lever 45, so that the contacts 21 in the magazine 15, the electronics 26, the grip safety 27 and the pushbutton switch 29, the group of the micro switches (the trigger detection switch 37 and the circuit breaker 39) and the contact lever 45 are above one another in the named sequence. Thus, the shortest possible current paths are produced that are relatively safe from damage because the current paths are produced in regions that are practically inaccessible and only may be reached non-destructively by experienced weapons mechanics should the need arise.

As described above, to prevent conventional ammunition that may be placed in the firearm 2 from being triggered by the impact of the firing pin 47 during forward motion of the breech block 7 (or even having any effect on a loaded cartridge), another example firing pin 73 (FIG. 4) is preferably designed having two parts, with one top part 63 turned to the bottom of a loaded cartridge and one base part 65 turned to the contact lever 45. The top part 63 and the base part 65 are coupled to one another via the spring means 67, wherein the weight of the top part 63 is less than that of the base part 65. The prevention of an indentation in or other contact with the bottom of a loaded cartridge without triggering a shot also may be required with electrically ignitable ammunition. In addition, to ensure absorption of the impact shock, the weight of the top part 63 is preferably less than that of the base part 65 by, for example, at least the factor 5, and in some example weapons, the weight of the top part 63 and the weight of the base part 65 may differ by a factor of 8.

Furthermore, in some examples, as stated above, the example firing pin 73 that has the top part 63 and the base part 65, may be axially movable with regard to the breech block 7. However, in alternative example, the firing pin 73 also may be fixed in axial direction with regard to the breech block 7.

The example firearm 2 may be any type of firearm, including, for example, a rifle, an automatic pistol, a submachine gun or the like. Preferably, however, the firearm 2 is a self-loading pistol, which may appear substantially similar to a conventional pistol with respect to the exterior appearance of the firearm 2. Further the operation of the example firearm, in terms of the numbers of shots the example firearm 2 is able to support, also is nearly identical to the number of shots that are able to be fired from a conventional pistol, at least in the civilian, non-military version. Further, due to the lack of a locking and cocking mechanism, which requires very high precision and is very susceptible to soiling, the example firearm 2 is simpler and more cost effective but also is easily dischargeable, i.e., a shot may be easily fired. In fact, even the first shot, which is triggered without prior cocking, is easily discharged like all shots. However the example firearm 2 is, when the safety is on or when the firearm 2 is not properly held in the hand of the marksman, completely safe, because then no ignition voltage is present when the firearm is idle. The electronics 26 are included and used to increase the voltage from the battery 19, which is initially insufficient to ignite cartridge. The voltage is increased to a relatively larger value such as, for example from 6 volts to 60 volts. Thus, even if the firearm 2 is soiled, a cartridge may be triggered because the high voltage equalizes or otherwise may overcome potential resistances.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm for firing electrically ignitable cartridges, the firearm comprising:

an electric circuit;

a breech block;

a firing pin held in the breech block, wherein the firing pin includes an ignition tip; and a contact lever, wherein movement of the contact lever is coupled to movement of the breech block, wherein the contact lever is couplable to at least one of the electric circuit or the firing pin, wherein the contact lever interrupts electrical contact between the electric circuit and the firing pin when the breech block is open, wherein the firing pin is axially movable opposite the breech block between a first position and a second position, wherein in the first position the firing pin protrudes from a face of the breech block, wherein in the second position, the firing pin does not protrude from the face of the breech block, wherein a firing pin spring pre-stresses the firing pin into the first position, and wherein the contact lever is pre-stressed by a contact lever spring into engagement with the firing pin when the breech block is closed, and wherein the elastic force of the contact lever spring is greater than the elastic force of the firing pin spring.

2. A firearm as defined in claim 1, further comprising:

a swiveling axis about which the contact lever is pivotable;

a point of contact on the contact lever, wherein the point of contact is electrically conductive; and a sliding contact, wherein the point of contact and the sliding contact are electrically coupled when the breech block is closed.

3. A firearm as defined in claim 1, further comprising:

a swiveling axis about which the contact lever is pivotable;

a point of contact, wherein the point of contact is electrically conductive; and a sliding contact, wherein the point of contact and the sliding contact are electrically coupled based on the movement of the contact lever about the swiveling axis.

4. A firearm as defined in claim 1, wherein the firing pin is electrically insulated from the breech block.

5. A firearm as defined in claim 1, wherein a loaded cartridge and the electric circuit are electrically coupled through at least a first route or a second route, wherein the first route is through the firing pin and the contact lever and the second route is through the breech block.

6. A firearm as defined in claim 1, wherein there is no electrical contact between the firing pin and the contact lever when the breech block is open.

7. A firearm as defined in claim 1, further including a trigger detection switch coupled to a trigger, wherein the trigger detection switch activates the electric circuit when the trigger has been pulled.

8. A firearm as defined in claim 1, further including a circuit breaker coupled to a trigger, wherein the circuit breaker is activated when the trigger has been released.

9. A firearm as defined in claim 1, further including a trigger spring coupled to a trigger that guides the trigger toward a front position.

10. A firearm as defined in claim 9, wherein a force associated with the trigger spring is adjustable.

11. A firearm as defined in claim 1, further including a thrust piece coupled to a blade of a trigger, wherein after an initial actuation of the trigger, the thrust piece only permits a further actuation of the trigger with an increased elastic force.

12. A firearm as defined in claim 11, wherein a distance associated with the initial trigger actuation is adjustable.

13. A firearm as defined in claim 1, further comprising a grip that includes a grip space in which at least a portion of the electric circuit is positioned.

14. A firearm as defined in claim 1, wherein the firing pin includes a top part and a base part, wherein the top part is engageable with a cartridge, wherein the base part is engageable with the contact lever, wherein the top part and the base part are couplable via a spring means, and wherein a weight of top part is less than a weight of the base part.

15. A firearm as defined in claim 14, wherein the weight of the top part is less than the weight of the bottom part by at least a factor of 5.

16. A firearm as defined in claim 14, wherein the weight of the top part is less than the weight of the bottom part by a factor of 8.

17. A firearm as defined in claim 1, wherein the firing pin is axially fixed with respect to the breech block.

18. A firearm for firing electrically ignitable cartridges, the firearm comprising:

an electric circuit;

a breech block;

a firing pin held in the breech block, wherein the firing pin includes an ignition tip;

a contact lever, wherein movement of the contact lever is coupled to movement of the breech block, wherein the contact lever is couplable to at least one of the electric circuit or the firing pin, wherein the contact lever interrupts electrical contact between the electric circuit and the firing pin when the breech block is open; and a rod coupled to a trigger, wherein the rod includes a release piece that activates a trigger detection switch and a circuit breaker.

19. A firearm as defined in claim 18, wherein the firing pin is axially movable opposite the breech block between a first position and a second position, wherein in the first position the firing pin protrudes from a face of the breech block, wherein in the second position, the firing pin does not protrude from the face of the breech block, and wherein a firing pin spring pre-stresses the firing pin into the first position.

20. A firearm for firing electrically ignitable cartridges, the firearm comprising:

an electric circuit, wherein the electric circuit includes an identification device for identification of a marksman holding the firearm, wherein the identification device activates the electric circuit after identifying the marksman;

a breech block;

a firing pin held in the breech block, wherein the firing pin includes an ignition tip; and a contact lever, wherein movement of the contact lever is coupled to movement of the breech block, wherein the contact lever is couplable to at least one of the electric circuit or the firing pin, wherein the contact lever interrupts electrical contact between the electric circuit and the firing pin when the breech block is open.

21. A firearm for firing electrically ignitable cartridges, the firearm comprising:

an electric circuit, wherein the electric circuit includes a manually operable safety switch, wherein the pushbutton safety is actuated to activate the electric circuit;

a breech block;

a firing pin held in the breech block, wherein the firing pin includes an ignition tip; and a contact lever, wherein movement of the contact lever is coupled to movement of the breech block, wherein the contact lever is couplable to at least one of the electric circuit or the firing pin, wherein the contact lever interrupts electrical contact between the electric circuit and the firing pin when the breech block is open.

22. A firearm as defined in claim 21, wherein the manually operable safety switch is a pushbutton switch associated with a grip of the firearm.

23. A firearm as defined in claim 22, wherein the safety switch is housed in a rear side of the grip, wherein the safety switch may be actuated by a portion of a hand of a marksman between a thumb and an index finger.

24. A firearm for firing electrically ignitable cartridges, the firearm comprising:

an electric circuit, wherein the electric circuit applies an ignition voltage to the contact lever after the electric circuit has been activated by an identification device, a safety switch, a circuit breaker and a trigger detection device;

a breech block;

a firing pin held in the breech block, wherein the firing pin includes an ignition tip; and a contact lever, wherein movement of the contact lever is coupled to movement of the breech block, wherein the contact lever is couplable to at least one of the electric circuit or the firing pin, wherein the contact lever interrupts electrical contact between the electric circuit and the firing pin when the breech block is open.

25. A firearm for firing electrically ignitable cartridges, the firearm comprising:

an electric circuit including a battery, wherein the battery has an output voltage that is lower than a voltage required for triggering a shot; and a transformer circuit which transforms the output voltage of the battery to the voltage required for triggering a shot;

a breech block;

a firing pin held in the breech block, wherein the firing pin includes an ignition tip; and a contact lever, wherein movement of the contact lever is coupled to movement of the breech block, wherein the contact lever is couplable to at least one of the electric circuit or the firing pin, and wherein the contact lever interrupts electrical contact between the electric circuit and the firing pin when the breech block is open.

26. A firearm as defined in claim 25, further comprising:

a magazine; and a recessed space in a bottom of the magazine, wherein the recessed spaced includes the battery.

27. A firearm as defined in claim 26, wherein the recessed space may only be opened with a special tool or is not openable.

28. A firearm as defined in claim 26, further comprising:

at least one contact at a rear side of the recessed space, wherein the contact is coupled to the battery; and an opposing contact arranged in a well of the magazine, wherein the contact and the opposing contact cooperate.

* * * * *